United States Patent [19]

Loeliger

[11] Patent Number: 4,863,301

[45] Date of Patent: Sep. 5, 1989

[54] ROD-SHAPED DISPENSING DEVICE FOR RUBBABLE OR SCRAPABLE MASSES

[75] Inventor: Arnold Loeliger, Baar, Switzerland

[73] Assignee: Kolmar Cosmetics (Europa) AG, Switzerland

[21] Appl. No.: 524,556

[22] Filed: Aug. 19, 1983

[30] Foreign Application Priority Data

Aug. 23, 1982 [CH] Switzerland ..... 5005/82

[51] Int. Cl.[4] ..... A45D 40/02; A45D 40/20

[52] U.S. Cl. ..... 401/82; 401/84

[58] Field of Search ..... 401/82, 84

[56] References Cited

U.S. PATENT DOCUMENTS

| | | | |
|---|---|---|---|
| 809,419 | 1/1906 | Belcher | 401/82 X |
| 1,891,682 | 12/1932 | Meyer | 401/84 |
| 2,332,147 | 10/1943 | Holihan | 401/82 X |
| 2,333,813 | 11/1943 | Nyden . | |
| 2,347,774 | 5/1944 | Gelardin . | |
| 2,717,101 | 9/1955 | Van Handel | 401/82 X |
| 3,443,874 | 5/1969 | Pelli et al. | 401/82 |
| 3,810,700 | 5/1974 | Bryan . | |
| 3,991,775 | 11/1976 | Spatz . | |

FOREIGN PATENT DOCUMENTS

| | | | |
|---|---|---|---|
| 32091 | 7/1981 | European Pat. Off. . | |
| 414006 | 8/1910 | France | 401/82 |
| 805950 | 12/1936 | France | 401/82 |
| 987741 | 8/1951 | France . | |
| 1102920 | 10/1955 | France | 401/82 |
| 1204809 | 1/1960 | France | 401/84 |
| 1294437 | 4/1962 | France . | |
| 120538 | 11/1918 | United Kingdom . | |
| 128426 | 6/1919 | United Kingdom | 401/82 |
| 260512 | 11/1926 | United Kingdom | 401/82 |
| 755879 | 8/1956 | United Kingdom | 401/82 |

*Primary Examiner*—Steven A. Bratlie

*Attorney, Agent, or Firm*—Roylance, Abrams, Berdo & Goodman

[57] ABSTRACT

A dispensing device for rubbable or scrapable masses comprises an elongated, hollow tubular case for receiving the mass to be dispensed and a feeding mechanism, operable from outside the case, for moving the mass relative to the case. The case has a wall with a groove formed in it, which groove extends substantially in a longituidnal direction of the case. The feeding mechanism includes a connecting member longitudinally movable within the case, a web extending laterally from the connecting member and through the groove to an outside surface of the case, and an actuating member coupled to the web and accessible from outside the case. The web separates a portion of the wall defining the groove as the feeding mechanism is pushed along the groove.

14 Claims, No Drawings

ROD-SHAPED DISPENSING DEVICE FOR RUBBABLE OR SCRAPABLE MASSES

FIELD OF THE INVENTION

The present invention relates to a rod-shaped dispensing device for rubbable or scrapable masses.

BACKGROUND OF THE INVENTION

Conventional dispensing devices used, e.g., as cases for adhesive sticks, cosmetic sticks, etc. are relatively complicated. They generally comprise a plurality of individual parts making them costly to manufacture.

Filling the case with the mass to be dispensed is also normally difficult. In most cases, the case cannot be directly filled as the mass must be previously shaped, e.g., by being compressed or cast in molds. Any exposed portions on the mass shaped in this manner risks contamination during the further processing, particularly when being inserted in the case.

SUMMARY OF THE INVENTION

An object of the present invention is to provide a dispensing device for rubbable or scrapable masses which is simply and reliably constructed such that the device can be simply and inexpensively manufactured.

Another object of the present invention is to provide a dispensing device for rubbable or scrapable masses having a particularly high degree of protection against the mass running or leaking out under the action of heat or pressure.

The foregoing objects are basically attained by a dispensing device for rubbable or scrapable masses comprising an elongated, hollow tubular case for receiving the mass to be dispensed and a feeding mechanism, operable from outside the case, for moving the mass relative to the case. The case has a wall with a groove formed in it, which groove extends substantially in a longitudinal direction of the case. The feeding mechanism includes a connecting member longitudinally movable within the case, a web extending laterally from the connecting member and through the groove to an outside surface of the case, and an actuating member coupled to the web and accessible from outside the case. The web separates a portion of the wall defining the groove as the feeding mechanism is pushed along the groove.

By forming the present invention in this manner, a simple and inexpensively manufactured dispensing device is provided. Additionally, the device offers the desired protection against the running or leaking out of the mass under the influence of heat and/or pressure.

With the present invention, the mass can be inserted directly into the dispensing device, or can be joined separately with parts of the feeding mechanism and subsequently inserted in the case. It is particularly advantageous when the slot-shaped or groove shaped opening, formed in the case by the web, is closed again by the inherent resiliency of the case immediately behind the web. The immediate closing prevents remnants of the mass, which have been left behind the feeding device on the inner surface of the case, from escaping from the case.

Thus, the manufacture of the dispensing device and the filling of the mass to be dispensed are greatly simplified by the present invention. The dispensing device can be used for a wide variety of masses, for example, adhesive or cosmetic sticks or pencils, such as eye shadow, compact powder or lipsticks. It can also be used for dispensing a wax-like carrier substance with medical or cosmetic active ingredients. Additionally, masses which can be rubbed or wiped off, such as soft crayons or chalks, are suitable for use in the dispensing device of the present invention.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this original disclosure.

DETAILED DESCRIPTION OF PREFERRED EMBODIMENTS OF THE INVENTION

Figure 1:
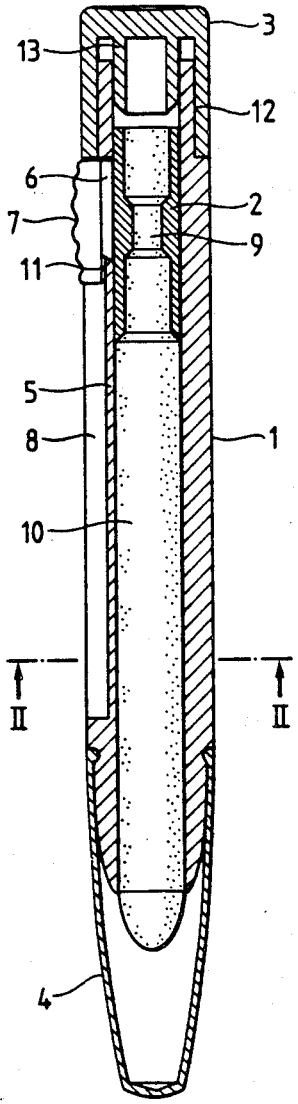
FIG. 1 is a side elevational view in section of a dispensing device according to a first embodiment of the present invention.
Figure 2A:
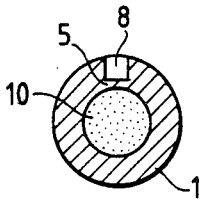
FIG. 2A is a front elevational view in section taken along lines II—II of FIG. 1.

Referring initially to FIG. 1, the rod-shaped dispensing device of the present invention comprises a cylindrical case 1, a feeding device or mechanism 2 longitudinally displaceable in the case, and an end cap 3 sealing the rear of the case. The front part of the case is closed by a removable cap 4. Case 1 has a substantially longitudinally directed grooved wall 5, shown in FIG. 2A.

The feeding device of the first embodiment has a plunger-like construction and includes a radially directed and preferably wedge-shaped web 6. Web 6 penetrates through the grooved wall 5 and is attached to an actuating member 7. Web 6 and/or actuating member 7 are preferably located within slot or groove 8.

Feeding device 2 also comprises a connecting member with a constriction profile 9, which connecting member holds the mass 10 to be dispensed within feeding device 2. For example, mass 10 can be shaped like a stick that projects out of the front end of case 1 to the extent necessary for satisfactory dispensing of the mass by rubbing or scraping.

The mass 10 can be directly introduced into case 1 from the front or the rear with the feeding device 2 being located at the rear. When mass 10 has hardened, constriction profile 9 of the connecting member acts as a friction- or formtight locking connection between the mass 10 and the plunger-like feeding device 2. However, mass 10 can also be separately joined to the feeding device 2, or can be pressed or cast therein and then introduced from the rear of and into case 1. The rear case opening is then closed with end cap 3.

Figure 5:
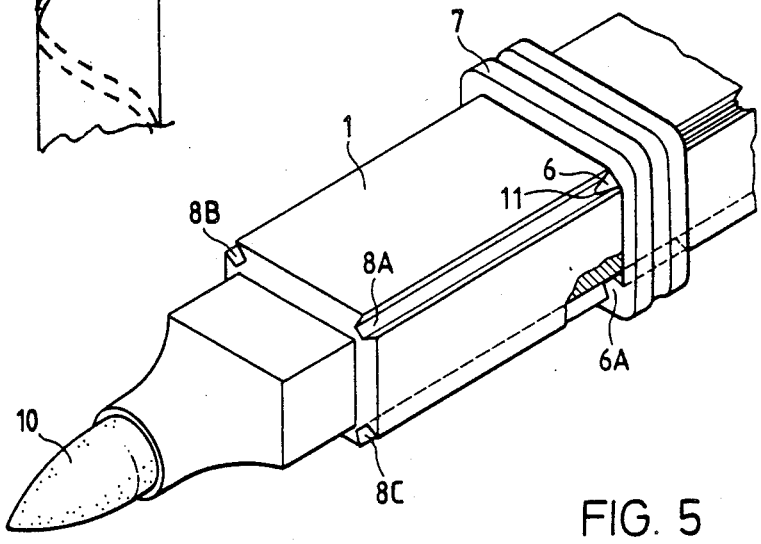
FIG. 5 is a partial perspective view of a dispensing device according to a fourth embodiment of the present invention.

Web 6 of feeding device 2 preferably has a slightly bevelled cutting edge 11. When advancing mass 10 by feeding device 2, the initially closed grooved wall 5 is gently opened. Due to the inherent resiliency of the case, and the coupling of the case in the rear part by the end cap 3 and in the front part by the closed grooved wall 5, the groove 8 is sealed in the vicinity of web 6. Preferably the rear end of web 6 also gradually tapers, e.g., has a wedge-like configuration as illustrated in FIG. 5, so that the case wall in the separated part of the grooved wall 5 closes and reseals after separation due to the elasticity or resiliency of the case material.

The closing or sealing action, as well as the mechanical stability of the case rear end is assisted by the coupling of end cap 3. In the illustrated embodiment, the end cap extends over the rear end of the case. To facilitate coupling of the end cap on the case, the rear end of the case has an external recess 12 which, according to the preferred embodiment, corresponds to the wall thickness of end cap 3 in this area. For improved locking of the case end in end cap 3, the cap has an inwardly directed concentric pin 13 with an external diameter corresponding to the internal diameter of the case.

Figure 3:
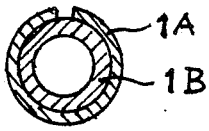
FIG. 3 is a partial front elevational view in section of a dispensing device according to another embodiment of the present invention.

Case 1 can be made from plastic, for example polyethylene or polypropylene, or can be made from metal, e.g., aluminum or some other relatively easily cuttable material. Alternatively, the case can be formed of two telescoped tubular parts as shown in FIG. 3. The outer part 1A is preferably in the form of a spring member to ensure resealing of the grooved wall, particularly in the rear, cut-open part of slot 8. The inner part 1B is made from relatively soft and easily cuttable material.

Figure 2B:
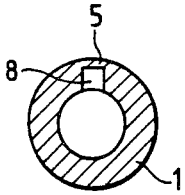
FIG. 2B is a front elevational view in section of a dispensing device according to a second embodiment of the present invention.
Figure 2C:
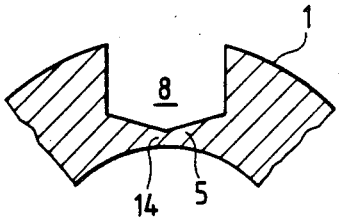
FIG. 2C is a partial front elevational view in section of a dispensing device according to a third embodiment of the present invention.

As is shown in FIG. 2B, an area of reduced wall thickness 5 can also remain in the outer wall area of case 1. Finally, according to FIG. 2C, the grooved wall can be formed in a trough-like manner for the inwardly arranged grooved wall of FIG. 2A and the outwardly arranged grooved wall of FIG. 2B. In the FIG. 2C embodiment, the grooved wall does not have a constant wall thickness, but has a weak line 14 in the central region of slot 8. This trough arrangement additionally guides the cutting edge 11 and consequently ensures a particularly smooth and clean cut in the central area of grooved wall 5.

Figure 4:
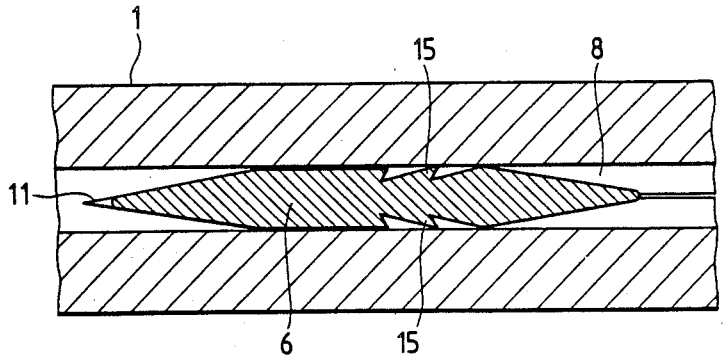
FIG. 4 is a partial top plan view in section of the barb mechanism for the dispensing device of the present invention.

Sliding back of feeding device 2 toward the rear area of case 1 is prevented by feeding device 2. Preferably, in the vicinity of web 6, barbs 15 are provided as illustrated in FIG. 4. The barbs engage the case wall, e.g., in the vicinity of slot 8 or in the other areas between the case wall and the feeding device. Barbs 15 permit forward movement of feeding device 2, but prevent the sliding back thereof.

FIG. 5 illustrates another embodiment wherein the case is rectangular in transverse cross section and has a plurality of guide slots 8A, 8B, 8C. Actuating member 7 is in the shape of a ring which surrounds case 1. A web 6 is preferably joined to the plunger arranged within the case. To assist in guiding the annular actuating member 7, guide webs 6A are arranged in slots 8B and 8C. These guide webs function only as guide members, and do not cut the case wall in the slots.

According to another embodiment, a case can be formed such that the grooved wall 5 is already open in slot-like manner, and resiliently or elastically gives way in the vicinity of web 6.

Figure 6:
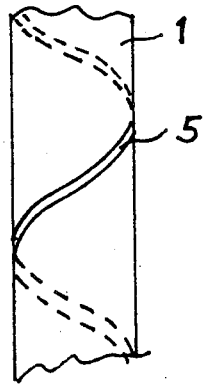
FIG. 6 is a partial side view of a further embodiment of the invention.

Finally, a grooved wall 5 can be provided along a random curve, e.g., a spiral, with the curve running substantially in the longitudinal direction of the case, as shown in FIG. 6.

While various embodiments have been chosen to illustrate the invention, it will be understood by those skilled in the art that various changes and modifications can be made therein without departing form the scope of the invention as defined in the appended claims.

What is claimed is:

1. A dispensing device for rubbable or scrapable masses, comprising:

an elongated, hollow tubular case formed of resilient material for receiving the mass to be dispensed, said case having a wall with a groove formed therein extending substantially in a longitudinal direction of said case and having an inner surface, said groove opening in a radially outward direction of said case and being closed by said wall in a radially inward direction of said case; and feeding means, operable from outside of said case, for moving the mass relative to said case, said feeding means including a connecting member longitudinally movable within said case and fixed to the mass, said inner surface of said case and said connecting member forming mold means for direct filling with the mass to be dispensed, a web having a cutting edge and extending laterally from said connecting member and through said groove to an outside surface of said case, and an actuating member coupled to said web and accessible from outside said case;

whereby said web cuts and separates a portion of said wall defining said groove as said feeding means if pushed along said groove.

2. A dispensing device according to claim 1 wherein said groove extends along a straight line extending parallel to a longitudinal axis of said case.

3. A dispensing device according to claim 2 wherein said wall in said grove has a non-uniform thickness.

4. A dispensing device according to claim 1 wherein said groove extends along a spiral path.

5. A dispensing device according to claim 1 wherein said actuating member is located in and is guided by said groove.

6. A dispensing device according to claim 1 wherein said actuating member comprises a ring surrounding said case.

7. A dispensing device according to claim 6 wherein said wall has a plurality of substantially longitudinally extending grooves; and said ring has a second web extending radially inwardly therefrom and received in one of said grooves to guide said ring.

8. A dispensing device according to claim 1 wherein said feeding means comprises barb means for engaging said wall of said case and preventing said feeding means from moving backwards relative to said case.

9. A dispensing device according to claim 1 wherein said case has an end cap extending over said wall at one end thereof, said cap having a pin received within said case, said pin having an outside diameter substantially equal to an internal diameter of said case.

10. A dispensing device according to claim 1 wherein said case comprises an inner tubular part and an outer tubular part, said inner part being made of softer material than said outer part.

11. A dispensing device according to claim 1 wherein said connecting member has means for forming a friction or form tight connection to the mass.

12. A dispensing device according to claim 1 wherein said mold means is completely filled with a dispensable mass such that said mass and said inner surface of said case are in surface to surface contact about entire transverse peripheries thereof, whereby said inner surface guides and frictionally resists feeding of said mass during feeding operations.

13. A dispensing device according to claim 12 wherein said inner surface has an essentially constant cross-sectional, closed configuration between said connecting member and a dispensing end of said case.

14. A dispensing device according to claim 1 wherein said inner surface has an essentially constant cross-sectional, closed configuration between said connecting member and a dispensing end of said case.

* * * * *